US008490354B2

(12) United States Patent
Robinson

(10) Patent No.: US 8,490,354 B2
(45) **Date of Patent: *Jul. 23, 2013**

(54) APPARATUS, SYSTEM, AND METHOD FOR CONSTRUCTING A WALL USING WALL BLOCKS

(75) Inventor: Michael M. Robinson, Rancho Mirage, CA (US)

(73) Assignee: Supreme Wall Building Systems, Inc., Thousand Palms, CA (US)

( * ) Notice: Subject to any disclaimer, the term of this patent is extended or adjusted under 35 U.S.C. 154(b) by 2926 days.

This patent is subject to a terminal disclaimer.

(21) Appl. No.: 10/950,146

(22) Filed: Sep. 25, 2004

(65) Prior Publication Data

US 2006/0070328 A1 Apr. 6, 2006

(51) Int. Cl.

| | |
|---|---|
| ***E02D 27/00*** | (2006.01) |
| ***E04B 1/02*** | (2006.01) |
| ***E04B 5/04*** | (2006.01) |
| ***E04C 3/30*** | (2006.01) |
| ***E04C 2/04*** | (2006.01) |

(52) U.S. Cl.
USPC ..... 52/293.2; 52/561; 52/607

(58) Field of Classification Search
USPC ..... 52/424, 284, 561, 293.2, 293.3, 607, 52/220.3, 220.5
See application file for complete search history.

(56) References Cited

U.S. PATENT DOCUMENTS

| | | | | |
|---|---|---|---|---|
| 142,475 | A | | 9/1873 | Hyatt |
| 581,142 | A | | 4/1897 | Schumacher |
| 1,400,407 | A | | 12/1921 | Blank |
| 1,671,893 | A | | 2/1928 | Easterday, Sr. |
| 1,836,408 | A | | 12/1931 | Sutton |
| 1,950,397 | A | * | 3/1934 | Cahill ..... 52/125.3 |
| 2,002,311 | A | | 5/1935 | Corwin |
| 2,598,867 | A | | 6/1952 | Weitz, Jr. |
| 2,701,959 | A | | 2/1955 | Briggs |
| 3,391,507 | A | | 7/1968 | Downing |
| 4,089,144 | A | | 5/1978 | Astl |
| 4,107,894 | A | * | 8/1978 | Mullins ..... 52/592.6 |
| 4,503,648 | A | | 3/1985 | Mahaffey |
| 4,614,071 | A | * | 9/1986 | Sams et al. ..... 52/309.12 |
| 4,765,116 | A | * | 8/1988 | Shank ..... 52/747.12 |
| 4,854,103 | A | | 8/1989 | Klym |
| 5,024,035 | A | | 6/1991 | Hanson et al. |
| 5,163,259 | A | | 11/1992 | Hunsaker |
| 5,375,384 | A | | 12/1994 | Wolfson |
| 5,433,047 | A | * | 7/1995 | Wallace et al. ..... 52/284 |
| 5,611,183 | A | * | 3/1997 | Kim ..... 52/426 |
| 5,653,080 | A | | 8/1997 | Bergeron |
| 5,657,597 | A | | 8/1997 | Loftus |
| 5,749,196 | A | * | 5/1998 | Bangma ..... 52/561 |

(Continued)

*Primary Examiner* — Andrew Triggs
(74) *Attorney, Agent, or Firm* — Gavrilovich, Dodd & Lindsey, LLP; Charles D. Gavrilovich, Jr.

(57) ABSTRACT

A wall block includes two finished wall material layers attached to a frame where the tops of the wall blocks are configured to support other wall blocks. Exterior wall blocks for constructing exterior walls include an interior wall material layer and an exterior wall material layer. Interior wall blocks include interior wall material layers on both vertical sides of the frame. Walls are formed by stacking and gluing the prefabricated wall blocks and vertically aligning the wall blocks in an offset or in a vertical configuration to form a stack bond, running bond, or offset running bond wall configuration. The interior wall material layers and exterior wall material layers do not require further finishing after a wall is assembled thereby greatly reducing labor costs.

111 Claims, 10 Drawing Sheets

U.S. PATENT DOCUMENTS

| | | | | | |
|---|---|---|---|---|---|
| 5,765,330 | A | | 6/1998 | Richard | |
| 5,814,253 | A | * | 9/1998 | Sikaffy et al. | 264/42 |
| 5,930,960 | A | | 8/1999 | Konnerth | |
| 5,966,894 | A | | 10/1999 | Crump, Jr. | |
| 6,016,632 | A | | 1/2000 | McGee et al. | |
| 6,044,603 | A | | 4/2000 | Bader | |
| 6,138,421 | A | * | 10/2000 | Grigsby | 52/293.2 |
| 6,138,426 | A | * | 10/2000 | Mork et al. | 52/562 |
| 6,151,857 | A | * | 11/2000 | Raschke | 52/426 |
| 6,244,005 | B1 | | 6/2001 | Wallin | |
| 6,311,441 | B1 | | 11/2001 | Beavers et al. | |
| 6,330,775 | B1 | | 12/2001 | Hubbard | |
| 6,412,244 | B2 | * | 7/2002 | Nolan | 52/315 |
| 6,412,245 | B1 | | 7/2002 | Lane | |
| 6,431,797 | B2 | * | 8/2002 | Greenberg | 405/284 |
| 6,508,038 | B2 | | 1/2003 | Al-Ghitta | |
| 7,305,803 | B2 | * | 12/2007 | Correa et al. | 52/604 |
| 2002/0026760 | A1 | * | 3/2002 | Moore, Jr. | 52/309.11 |
| 2005/0086892 | A1 | * | 4/2005 | Dean, Jr. | 52/604 |
| 2005/0138876 | A1 | * | 6/2005 | Sourlis | 52/302.1 |

* cited by examiner

APPARATUS, SYSTEM, AND METHOD FOR CONSTRUCTING A WALL USING WALL BLOCKS

BACKGROUND OF THE INVENTION

The invention relates in general to construction of buildings and more specifically to an apparatus, system, and method for constructing buildings using prefabricated wall blocks.

Any of several techniques may be used to form walls to construct buildings. One well established method of forming a wall includes constructing a frame from wood or aluminum studs, anchoring the frame to a foundation, applying an interior wall material in large sheets or panels and forming an exterior surface by applying concrete, brick, or wood to the exterior of the wall. This conventional technique is used to construct a great majority of residential buildings due to its relative low cost, the availability of materials, and relatively short time needed to complete a project. Conventional techniques, however, are limited in several ways. For example, additional finishing steps are typically required to complete the wall. Drywall is typically applied as an interior wall material by nailing or screwing large panels to the wooden frame and spackling and sanding the joints between the panels. Such steps greatly increase the time required to construct a building and also result in significant amounts of dust that must be removed before walls are painted, floors finished, and other steps are taken to prepare the structure for habitation. Further, the exterior of the wall must also be finished by forming a brick or concrete outer surface for durability and protection from the outdoor elements. Construction labor costs are a significant portion of the total cost of constructing a building. As a result, the labor hours required to finish walls can add significant cost to the total construction project.

Accordingly, there is a need for an efficient apparatus, system, and method for constructing a building.

DETAILED DESCRIPTION

In the exemplary embodiments of the invention, an apparatus, system, and method for constructing a building include forming walls with prefabricated wall blocks comprising two finished wall material layers connected to opposite sides of a frame. Exterior wall blocks for constructing exterior walls include an interior wall material layer and an exterior wall material layer. Interior wall blocks include interior wall material layers on both vertical sides of the frame. Walls are formed by stacking the prefabricated blocks and vertically aligning the wall blocks in an offset or in a vertical configuration to form a stack bond, running bond, or offset running bond wall configuration. In the exemplary embodiment, an adhesive is applied between the top and bottom surfaces as well as between the adjacent vertical sides of the wall blocks to secure the wall blocks in the aligned position. The interior wall material layers and exterior wall material layers do not require further finishing after a wall is assembled thereby greatly reducing labor costs. Further, the exemplary wall blocks include openings that form conduit channels extending from the top of a completed wall allowing wires and other items to be routed through the wall after the wall is completed and without significant alteration to the wall.

Figure 1B:
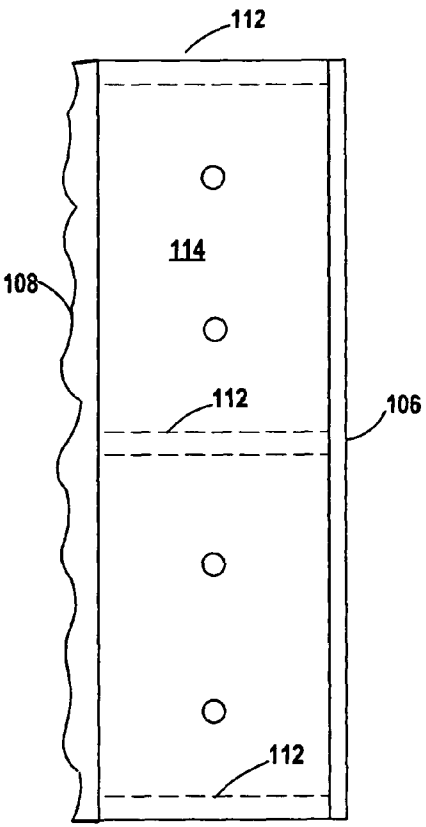
FIG. 1B is an illustration of a top view of a wall block in accordance with the exemplary embodiment of the invention.
Figure 1A:
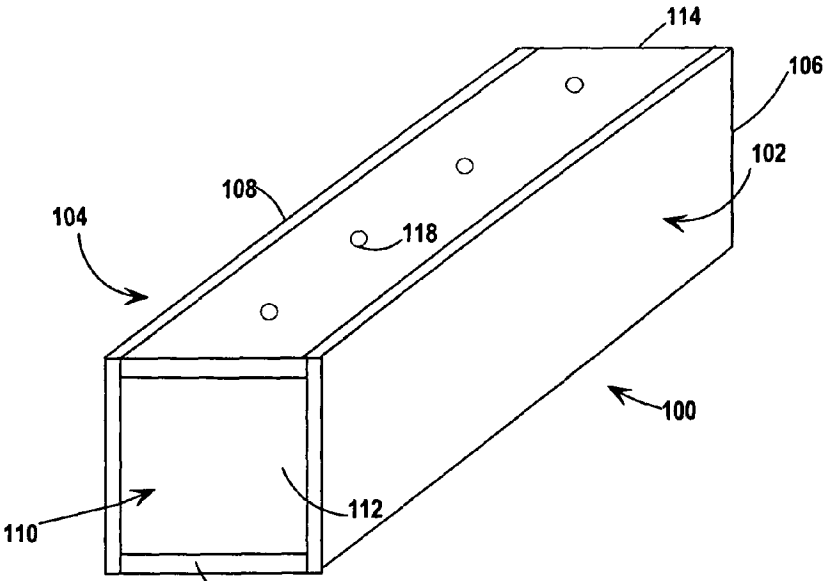
FIG. 1A is an illustration of a perspective view of a wall block in accordance with an exemplary embodiment of the invention.

FIG. 1A is an illustration of a perspective view and FIG. 1B is an illustration of a top view of a wall block 100 in accordance with an exemplary embodiment of the invention. The lines and shapes representing the components of the wall blocks in FIG. 1A and FIG. 1B are not necessarily drawn to scale and illustrate the relative dimensions of the components. As discussed in further detail below with reference to FIG. 6, wall blocks 100 of different sizes are used to erect a wall in the exemplary embodiment. Also, an exemplary system of wall blocks may include special purpose wall blocks such as wall blocks to be used to form corners and wall blocks for use in a base layer of a wall. Accordingly, FIG. 1A and FIG. 1B are block diagrams of an exemplary configuration and size and some of the features illustrated may vary depending on the particular type of wall block 100. Throughout this description, "wall block 100" broadly refers to all types, sizes, and special purpose wall blocks. Other reference numbers are used to specify wall blocks having specific characteristics, sizes, or placement within a wall.

The wall block 100 includes at least two vertical sides 102, 104, where each vertical side includes a finished wall material layer 106, 108. Where the wall block 100 is intended for constructing an interior wall, the finished wall materials layers 106, 108 are both interior wall material layers. If the wall block 100 is used to build an exterior wall, one of the material layers 106 is an interior wall material layer 106 and the other is an exterior wall material layer 108.

The finished wall material layers 106, 108 are secured to a frame 110. The frame 110 is discussed in further detail with reference to FIG. 2 and may include any number of members that form a rigid or semi-rigid structure having sufficient shear and compressive strengths to facilitate vertically stacking several wall blocks 100 to construct a wall. In the exemplary embodiment, the frame 110 is constructed by securing two or more vertical members 112 to two or more lateral members that include a top lateral member 114 and a bottom lateral member 116. The top lateral member 114 is configured to interface with a bottom lateral member 116 of one or more other wall blocks 100 when the wall blocks 100 are stacked to build a wall. In the exemplary embodiments, the top lateral member 114 and the bottom lateral member 116 are horizontal planar panels that form a level interface when the wall blocks 100 are stacked. In some circumstances the top lateral members 114 and the bottom lateral members 116 may have other configurations that allow a suitable interface between the wall blocks 100.

The interior material layer 106 consists of any material suitable for use on the inside of a wall of a building. In the exemplary embodiment, the interior material layer 106 is a section of planar material with adequate durability, moisture, and thermal characteristics in accordance with accepted construction practices. Examples of suitable materials include drywall such as gypsum board, wood paneling, and synthetic paneling. In the exemplary embodiment, the interior material layer 106 is a ½" sheet of drywall. The interior material layer 106 is attached to the frame 110 by any of several suitable bonding or mechanical mechanisms. For example, any combination of glue, nails, screws, and staples may be used to secure the interior material layer 106 to the frame 110. In the exemplary embodiment, a section of drywall (106) is screwed to the frame 110 using drywall screws. Any indentations, holes, or other deformations are spackled and smoothed by sanding or other finishing techniques. The interior material layer 106 may be further finished by painting or applying wall coverings such as wall paper.

As discussed in further detail below, an interior edge protector (not shown in FIG. 1A or FIG. 1B) forms a frame along the perimeter of the interior material layer 106 in the exemplary embodiment. Although the edges of the wall blocks 100 may not need to be protected in all cases, guarding the edges from cracking, splintering, or otherwise wearing before the wall is assembled, ensures an esthetically pleasing, as well as functional, joint between the interior material layers 106 of the wall blocks 100 after the wall is constructed. As discussed below in further detail, the interior edge protector may include several sections.

The exterior material layer 108 is formed from any material suitable for use on the outer surface of a building wall. In the exemplary embodiment, a concrete based mixture is applied to a wire fabric lathe over a sheathing to form a solid wire-reinforced layer. In some circumstances, a "scratch and brown" coating process is applied in accordance with known techniques to form any of several designs and appearances. The concrete mixture may be manipulated, shaped, and textured to create a stone, brick, or stucco appearance. When a wall is formed using wall blocks 100 having a stone appearance, for example, the wall resembles a stone wall when viewed from the outside of the building. In addition to stamped concrete and stucco finishes, the exterior material layer 108 may be a section of prefabricated synthetic material having a simulated surface. As is known, such materials are commercially available in prefabricated synthetic panels and may be formed from plastics such as polypropylene. Further, veneer layers and siding may be applied to form the exterior material layer 108 in some circumstances.

In the exemplary embodiment, the interior of the wall block 100 is at least partially filled with insulation (not shown). Although the insulation is placed within the interior of the wall block 100 prior to enclosing the interior during manufacturing of the wall block 100, the insulation may be injected into the interior through an opening in some situations. An example of a suitable insulation includes fiberglass insulations having a rating of R21.

Each wall block 100 may include one or more conduit channels 118 extending from the top lateral member 114 of the wall block 100 to the bottom lateral member 116 of the wall block 100. As explained below in further detail, the conduit channels 118 provide a channel for guiding conduit or other items through the wall after the wall is completed. The conduit may be used to route electrical wires, computer wires, speaker wires, coaxial cable, alarm wires, telephone wires, or antenna wires. In some situations, the conduit channels 118 may provide a channel to route other types of materials such as plumbing pipes.

Figure 2:
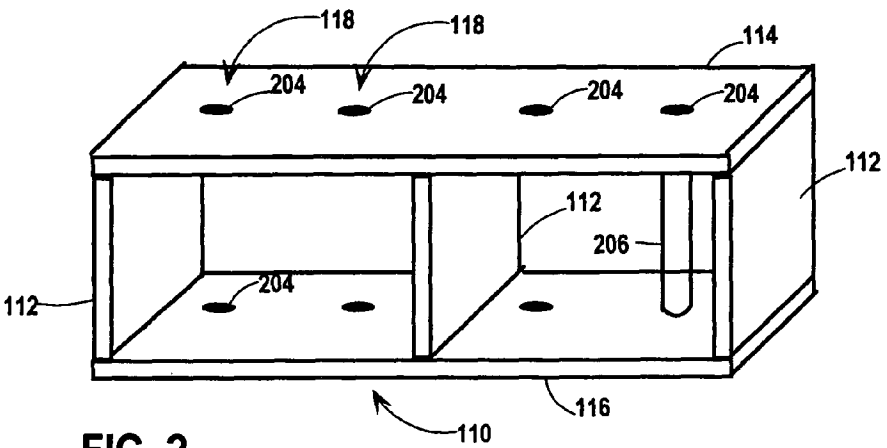
FIG. 2 is an illustration of a perspective view of a frame of the exemplary wall block.

FIG. 2 is an illustration of a perspective view of the frame 110 in accordance with the exemplary embodiment of the invention. In the exemplary embodiment, the frame 110 is constructed from lumber and includes the top lateral member 114, vertical members 112 at each end of the wall block 100, a central vertical member 112 at the midpoint between the two ends and a bottom lateral member 116. The frame members 112, 114, 116 are secured to each other using any of several suitable bonding or mechanical mechanisms. For example, any combination of glue, nails, screws, and staples may be used to construct the frame 110. In the exemplary embodiment, frame members 112, 114, 116 are cut from 2×6 lumber and secured using screws. Based on these teachings as applied to known techniques, those skilled in the art will recognize the various other methods for constructing the frame 110. For example, the frame 110 may include several lateral and vertical members as well as diagonal support members or shear panels for enhanced durability and strength.

Holes 204 in the top lateral member 114 and the bottom lateral member 116 provide openings for forming the conduit channel 118. The holes 204 in the top and bottom lateral members 114, 116 are aligned to form a vertical conduit channel 118 that is parallel with the vertical members 112. In the exemplary embodiments, one or more of the conduit channels 118 include a conduit channel guide 206, such as a section of PVC (Polyvinyl Chloride) piping or conduit, secured between the holes 204. For the purposes of clarity, only one conduit channel guide 206 is shown in FIG. 2. The conduit channel guides 206 are glued or otherwise sealed to with the frame 110. In the exemplary embodiments, the conduit channel guides 206 are secured between the top and bottom later members 114, 116 using a silicone sealant.

Although the wall blocks 100 may be fabricated at the wall construction site, the wall blocks 100 are manufactured in a manufacturing facility that provides a favorable environment to build the wall blocks 100 and maximize quality. Precise cutting, aligning, and assembly of the wall blocks 100 minimizes imperfections and defects resulting in a solid, well formed wall with tightly sealed joints. An exemplary method of manufacturing the wall blocks is discussed with reference to FIG. 9 below and generally includes simultaneously cutting components for several wall blocks 100, utilizing jigs and other alignment equipment to align the components, and securing the components using fasteners such as screws.

Figure 3:
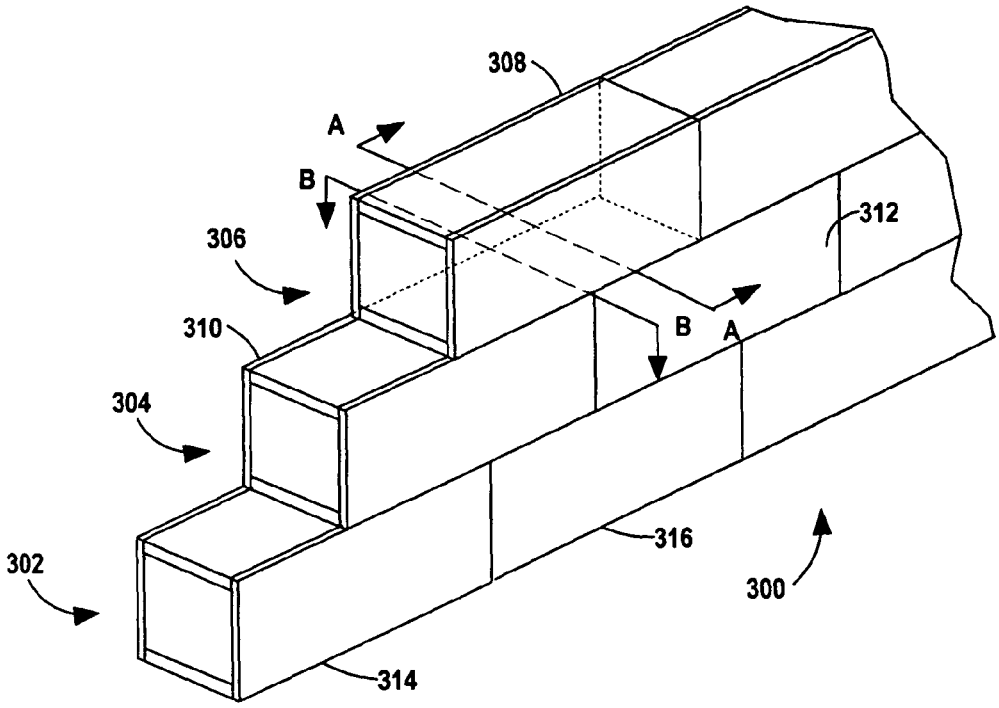
FIG. 3 is an illustration of a perspective view of a partial wall constructed using wall blocks in accordance with the exemplary embodiment of the invention.

FIG. 3 is a block diagram of a perspective view of a partially completed wall 300 constructed using wall blocks 100 in a running bond configuration. As discussed above, the wall blocks 100 may have different sizes and may be used to build walls having any of several configurations. In the interest of clarity, some features of an exemplary wall 300 are not shown in FIG. 3. For example, FIG. 3 does not depict the conduit channels 118 of walls 300 built in accordance with the exemplary embodiments. Further, the wall 300 may include any number of wall blocks 100 and may include other components such as, for example, corner posts, window frames, door frames, headers, outlets, pipes, fasters, and anchors.

The partially constructed exemplary wall 300 in FIG. 3 includes three wall block layers 302, 304, 306 including a base layer 302, and standard layers 304, 306. The number of standard layers 304, 306 of a completed wall depends on the height of the wall blocks 100 and the height of the particular wall. As described in further detail below, the wall blocks 100 in the base layer 302 are secured to a building foundation with anchors. Subsequent standard layers 304, 306 are formed by applying an adhesive and positioning the wall blocks 100 in the desired configuration. In a running bond configuration, an upper wall block 308 is positioned over two lower wall blocks 310, 312. The identification of a wall block 100 as an upper wall block or a lower wall block depends on the relation of the wall block 100 to other wall block layers (302, 304, 306). A lower wall block 310 relative to one layer 306, may be identified as an upper wall block 310 to wall blocks 314, 316 in another layer 302. Further, the wall blocks 310, 312 secured to each other in a layer 304 are referred to as adjacent wall blocks 310, 312 as well as lower wall blocks 310, 312. Examples of the interface between an upper wall block 308 and a lower wall block 312 and the interface between adjacent wall blocks 310, 312 are discussed below with reference to FIG. 4A, FIG. 4B, FIG. 5A, and FIG. 5B.

Figure 4A:
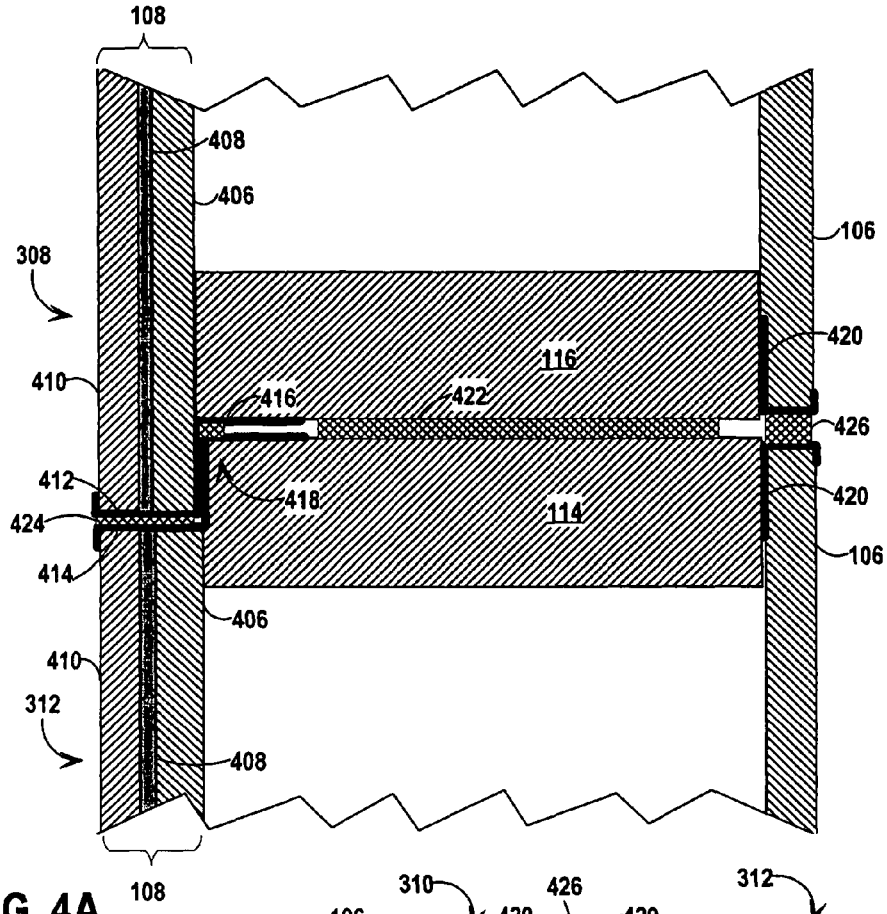
FIG. 4A is a block diagram of a cross-sectional side view taken along line A-A of FIG. 3 of an interface between an upper wall block supported and connected to a lower wall block in accordance with a first exemplary interface.

FIG. 4A is a block diagram of a cross-sectional side view taken along line A-A of FIG. 3 of an interface between an upper wall block 308 supported and connected to a lower wall block 312 where the wall blocks 308, 312 are used to construct an exterior wall 300 in accordance with a first exemplary embodiment. FIG. 4A shows a bottom portion of the upper wall block 308 and a top portion of the lower wall block 312.

The exterior wall material layer 108 may be any type of cement, concrete, polyurethane, or synthetic material having the appropriate insulation, thermal, and durability characteristics consistent with industry accepted exterior wall finishes. Further, a pliable mixture may be applied to a lathing structure and allowed to harden to form the exterior wall material layer 108 as discussed above. The exterior wall material layer 108 includes a sheathing layer 406, lathing 408, and a concrete layer 410 in the exemplary embodiment. The sheathing layer 406 is a layer of any suitable material providing the appropriate insulation and moisture penetration characteristics. Examples of suitable materials for the sheathing layer 406 include plywood and oriented strand board (OSB). In the exemplary embodiment, the sheathing layer 406 is a ½ inch thick plywood panel that is attached to the frame 110 with screws. Other fasteners such as nails and staples may be used in some circumstances and any combination of fasteners and adhesives may be used. The lathing 408 includes at least a moisture barrier such as a sheet of asphalt felt and may include supporting structure such a wire mesh. The concrete layer 410 may include multiple layers or may be formed from a single concrete layer that is applied to the lathing and allowed to harden. The concrete layer may use a stucco finish or may be stamped to create a stone or brick appearance. As discussed above, synthetic simulated materials, such as panels and veneers, may be used for the exterior layer in some circumstances. An example of a suitable method of attaching a preformed panel includes gluing the synthetic panel to the sheathing layer 406. If a preformed panel includes sheathing, the panel may be attached directly to the frame 110. Accordingly, the exterior wall material layer 108 may include a synthetic panel and a sheathing later 406 where simulated panels are used.

In the first exemplary embodiment, an lower exterior edge interface 412 is attached to the bottom edge of the bottom lateral member 116 on the exterior side 104 and an upper exterior edge interface 414 is attached to the top edge of the top lateral member 114. The exterior edge interfaces 412, 414 may be formed from any suitable material such, as sheet metal, and attached to the wall block using screws. Other types of bonding and mechanical securing mechanisms may be used in some circumstances. For example, any combination of adhesives, glues, nails, screws, staples, and other fasteners may be used. In the first exemplary embodiment, the exterior wall material layer 108 is offset slightly from the frame 110 such that the bottom portion of the exterior wall material layer 108 extends past the bottom edge of the bottom lateral member 116 and the top portion is positioned below the top edge of the top lateral member 114. An example of a suitable offset is one inch. The edge interfaces 412, 414 follow the contours of the offsets. The edge interfaces 412, 414 protect the edges of the wall block 100 from dents, cracking and other wear and provide flat surfaces that allow a tight seal to be formed between the wall blocks 402, 404 (100). In some circumstances, a bead of silicone sealant 416 is applied between the edge interfaces 412, 414 at an inner corner 418 to further ensure a weather tight seal between the wall blocks 402, 404.

In the exemplary embodiments, an interior edge interface 420 forms a frame around the perimeter of the interior wall material layer 106. The interior edge interface 420 may be formed from any suitable material, such as sheet metal, and attached to the wall block using screws. Other types of bonding and mechanical securing mechanisms may be used in some circumstances. For example any combination of adhesives, glues, nails, screws, staples, and fasteners may be used. The interior wall material layer 106 is a section of drywall in the exemplary embodiment that is screwed onto the frame 110.

When a wall 300 is constructed using the wall blocks 308, 312 (100), an adhesive 422 is applied to the top surfaces of top members 114 of lower wall blocks 404 before an upper wall block 402 is positioned on top of the lower blocks 402. In the exemplary embodiment, adjacent layers of wall blocks 100 are offset by one half the length of the wall block 100. For the main portion of the wall, each upper wall block 308 rests on two lower wall blocks 310, 312. As explained in further detail below, different size wall blocks 100 and corner wall blocks allow the vertical sides of the wall blocks 100 to coincide at an end of a wall. Accordingly, one end of an upper wall block may be positioned along the length of a lower wall block while the opposite end of the upper wall block coincides with the end of the lower wall block. FIG. 3 illustrates a partial wall constructed using a standard running bond where the edges of wall blocks 100 in alternating layers are aligned. Any of several offsets, however, may be used to construct a wall 300 to form a standard running bond, offset running bond, or stack bond wall configuration. The particular choice of offset may depend on the relative wall block 100 sizes and the desired appearance of the wall as well as other factors that will be readily apparent to those skilled in the art based on these teachings as applied to known construction techniques.

After the layers 302-306 of wall blocks 100 are secured, interior caulk 424 and exterior caulk 426 are applied to the gaps between the interior wall material layers 106 and exterior wall material layers 108, respectively. The caulks 424, 426 may be any type of suitable silicone or latex caulk with suitable elasticity, durability, and moisture resistance. In some circumstances, other sealing materials, such as grout, may be used in place of caulk 424, 426. As explained below with reference to FIGS. 5A and 5B, expandable foam may be used to seal the areas between the wall blocks 100 prior to the application of the interior caulk 424 and exterior caulk 426. Caulk may be omitted in some situations. For example, the sole use of expandable foam may be adequate in some circumstances. Examples of suitable expandable foams include commercially available expanding single-component polyurethane foam sealants.

Figure 4B:
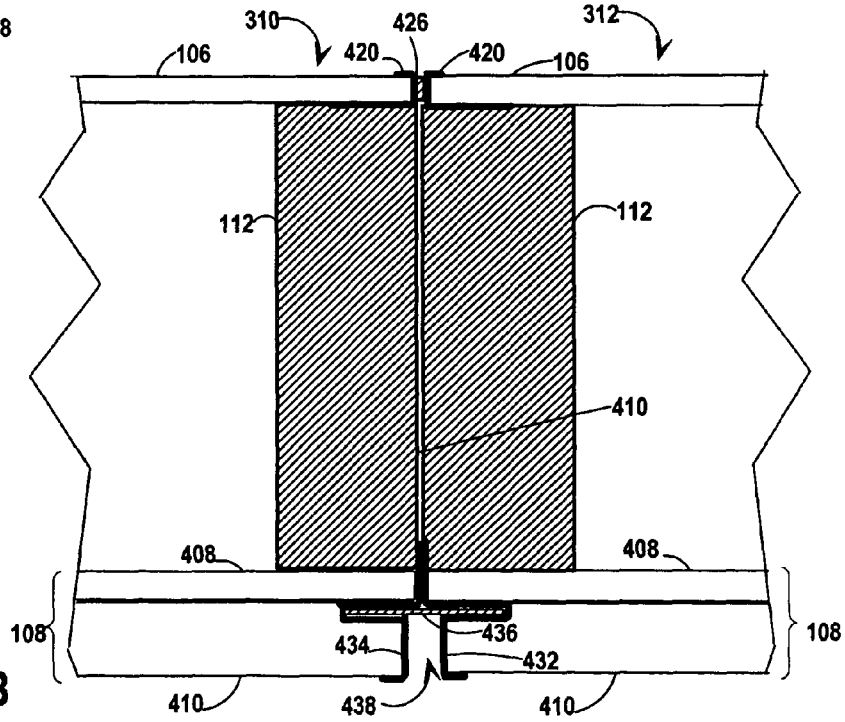
FIG. 4B is a block diagram of a top view taken at line B-B in FIG. 3 of two adjacent wall blocks positioned within a layer of a wall in accordance with the first exemplary interface.

FIG. 4B is a block diagram of a top view taken at line B-B in FIG. 3 of two adjacent wall blocks 310, 312 positioned within a layer 304 of a wall 300 in accordance with a first exemplary embodiment. Each wall block 100 includes a left edge interface 432 and a right edge interface 434. In the exemplary embodiment, the edge interfaces 432, 434 are formed from sheet metal and are mounted along the vertical edges of the wall blocks 310, 312 (100). An adhesive 422 is applied to the exterior surface of one or both of the end vertical members 112 of the wall blocks 310, 312 before the wall blocks 310, 312 are positioned within the wall layer 304. After the blocks 310, 312 are positioned, a retaining insert 436 is guided through the channel 438 formed by the edge interfaces 432, 434. A silicone sealer is applied to the surfaces of the edge interfaces 432, 434 in order to create a weather tight seal between the wall blocks 310, 312. Although any of several materials may be used for the retaining insert 436, the retaining insert 436 is a flat metal insert formed from sheet metal in the first exemplary embodiment.

Figure 5A:
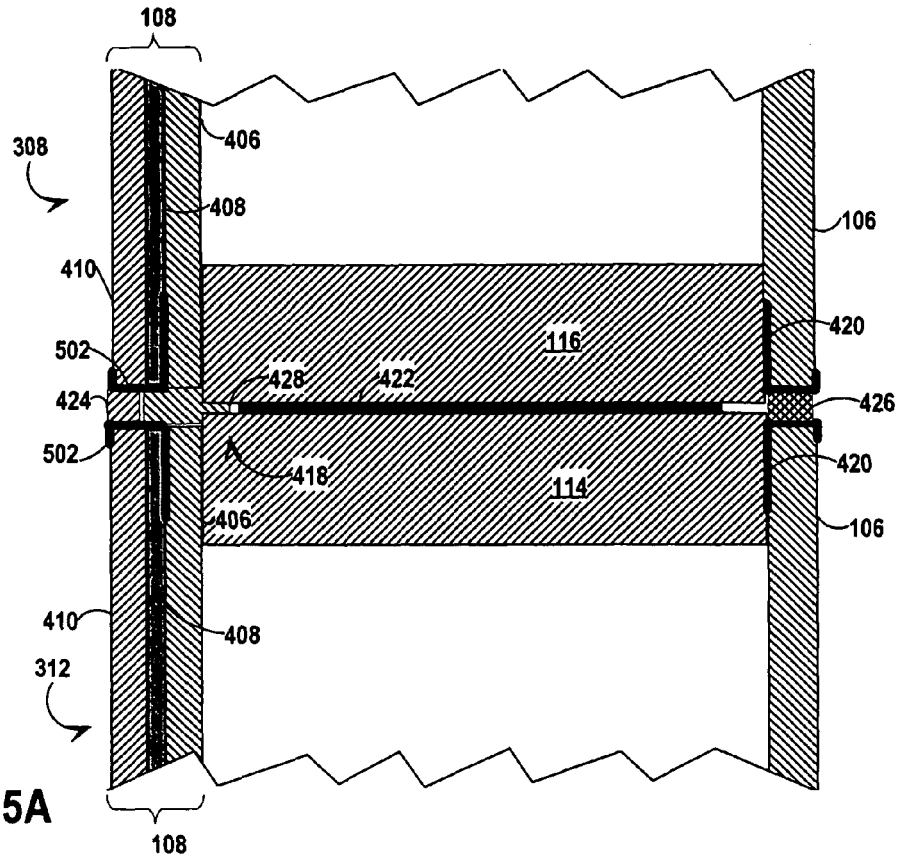
FIG. 5A is a block diagram of a cross-sectional side view taken along line A-A of FIG. 3 of an interface between an upper wall block supported and connected to a lower wall block in accordance with a second exemplary interface.
Figure 5B:
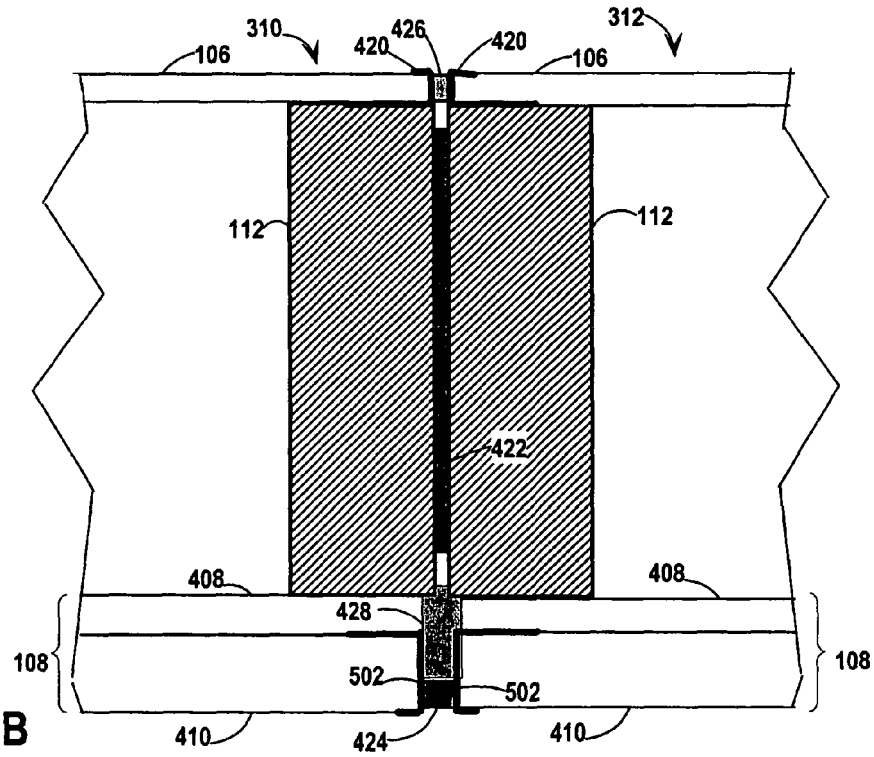
FIG. 5B is a block diagram of a top view taken at line B-B in FIG. 3 of two adjacent wall blocks positioned within a layer of a wall in accordance with the second exemplary interface.

FIG. 5A and FIG. 5B are block diagram of interfaces formed between blocks 100 in accordance with a second exemplary embodiment. FIG. 5A is a block diagram of a cross-sectional side view taken along line A-A of FIG. 3 of an interface between an upper wall block 308 supported and connected to a lower wall block 312 where the wall blocks 308, 312 are used to construct an exterior wall 300 in accordance with the second exemplary embodiment. FIG. 5A shows a bottom portion of the upper wall block 308 and a top portion of the lower wall block 312. FIG. 5B is a block diagram of a top view taken at line B-B in FIG. 3 of two adjacent wall blocks 310, 312 positioned within a layer 304 of a wall 300 in accordance with the second exemplary embodiment.

In the second exemplary embodiment, an exterior edge interface 502 forms a frame around the perimeter of the exterior wall material layer 108. The exterior edge interface 420 may be formed from any suitable material that protects the edges of the wall block 100 as well as providing an interface to the joints between wall blocks 100 positioned in a all. In the second exemplary embodiment, the exterior edge interface 502 is a sheet metal frame formed from four sections of "J metal" that are attached to the wall block 100 using screws. Other types of bonding and mechanical securing mechanisms may be used in some circumstances. For example any combination of adhesives, glues, nails, screws, staples, and fasteners may be used. The exterior edge interface is positioned between the sheathing layer 406 and the lathing 408. Those skilled in the art will readily recognize the various alternative materials and configurations of the exterior edge interface 502 that can be used based on these teachings as applied to known techniques.

The wall blocks 100 in accordance with the second exemplary embodiment are similar to the wall blocks 100 in the first exemplary embodiment except that second exemplary wall blocks do not include offsets. After the wall blocks 100 are stacked and secured with adhesive 422, an expandable foam 428 is injected into the joints between the wall blocks 100. The expandable foam 428 easily flows into the gaps between the edges of the wall blocks and fills voids while in a semi-liquid state. As the foam hardens and cures, the expandable foam 416 further expands to form a weather tight seal between the edges of the wall blocks 100. Silicon 424 or other sealants can be applied over the expandable foam 428 for an additional seal or for esthetic purposes.

FIG. 6A through FIG. 6F are block diagrams of side views of wall blocks 100 in accordance with the exemplary wall block sizes and conduit channel configurations. The wall blocks 100 are described in terms of units to illustrate relationships between the various sized wall blocks 100. Examples of suitable units include 8 inches and 12 inches. Other dimensions may be used for a unit, however. Although a wall 300 may be constructed with only two sizes of wall blocks 100, a variety of wall block sizes provides flexibility when constructing a wall 300. Other sizes and combinations of wall block 100 sizes may be used to construct walls and buildings. In accordance with the exemplary system and method of constructing a building, the wall blocks 100 used to construct a building are selected from a collection of twenty four wall blocks 100. The wall blocks 100 have a height of 2 units and a thickness of approximately 8 inches and are manufactured in six basic lengths including lengths of 1, 1.5, 2, 3, 3.5 and 4 units. As explained in further detail below, some wall blocks include features to facilitate use in particular locations within a wall 300. For example, the first layer (base layer) 302 in a wall 300 is constructed using base wall blocks that include features to secure the base wall blocks to the foundation of the structure. Base wall blocks are discussed in further detail with reference to FIG. 8 and FIG. 9. Wall blocks 100 on one wall of an inside corner of an exterior wall include features to allow close-fitting interface between the walls forming the inside corner. Therefore, wall blocks 100 used for exterior walls include base wall blocks, inside corner base wall blocks, standard inside wall blocks and standard wall blocks. Accordingly, each of the wall blocks 100 discussed with reference to FIG. 6A through FIG. 6F are manufactured in each of the four configurations in accordance with the exemplary method and system.

Figure 6A:
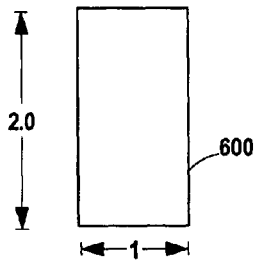
FIG. 6A through FIG. 6F are block diagram side views of exemplary wall blocks having different lengths in accordance with the exemplary embodiment of the invention.
Figure 6D:
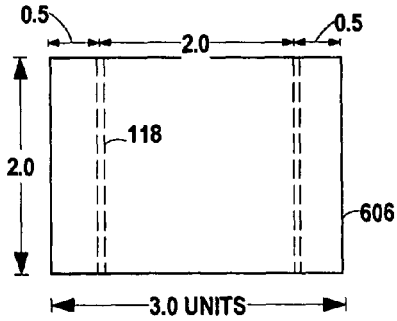
Figure 6B:
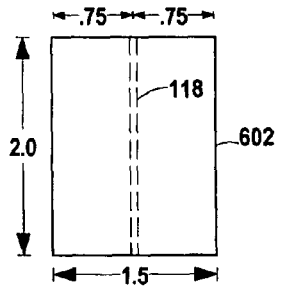
Figure 6E:
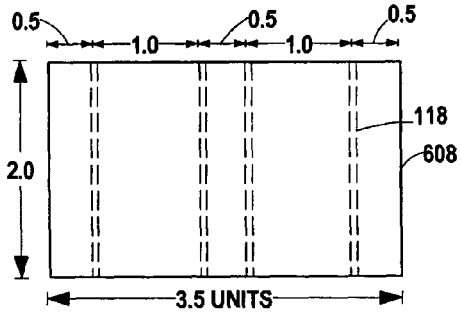
Figure 6C:
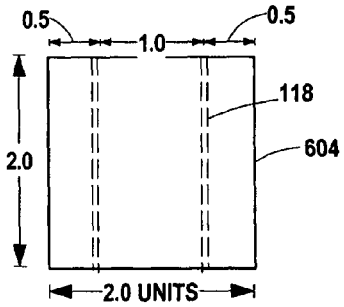
Figure 6F:
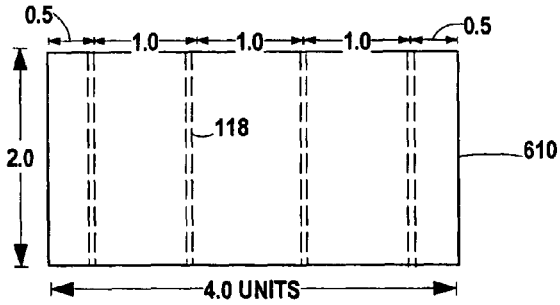

FIG. 6A is a block diagram of a side view of an exemplary single unit wall block 600. In the exemplary embodiment, the single unit wall block 600 has a height of 2 units and a length of 1 unit. The single unit wall block 600 does not include a conduit channel 118 channel for routing conduit. FIG. 6B is a block diagram of a side view of an exemplary 1.5 unit wall block 602. The 1.5 unit wall block is 1.5 units in length and includes single conduit channel 118 extending through the center of the block 602 from the top lateral member 114 to the bottom lateral member 116. FIG. 6C is a block diagram of a side view of an exemplary 2 unit wall block 604. The 2 unit wall block 604 has a length of 2 units and includes two conduit channels 118 centered along the length of the wall block 604, separated by 1 unit and extending from the top lateral member 114 to the bottom lateral member 116. The conduit channels 118 are 0.5 units from the edge of the wall block 604. FIG. 6D is a block diagram of a side view of a unit wall block 606. The 3 unit wall block is 3 units long and includes two conduit channels 118 separated by 2 units and extending from the top lateral member 114 to the bottom lateral member 116. The conduit channels 118 are 0.5 units from the edge of the wall block 606. FIG. 6E is a block diagram of an exemplary 3.5 unit wall block 608 having a length of 3.5 units and including four conduit channels 118. The two outer conduit channels 118 are 0.5 units from the edges of the wall block 608. The inner conduit channels are separated by 0.5 units and are 1.5 units from the edges of the wall block 608. FIG. 6E is a block diagram of an exemplary 4 unit wall block 610. In the exemplary embodiment, the 4 unit wall block is 4 feet long and includes four conduit channels 118. The two outer conduit channels 118 are 0.5 units from the edges of the wall block 610. The inner conduit channels are separated by 1.0 units and are 1.5 units from the edges of the wall block 610.

Figure 7A:
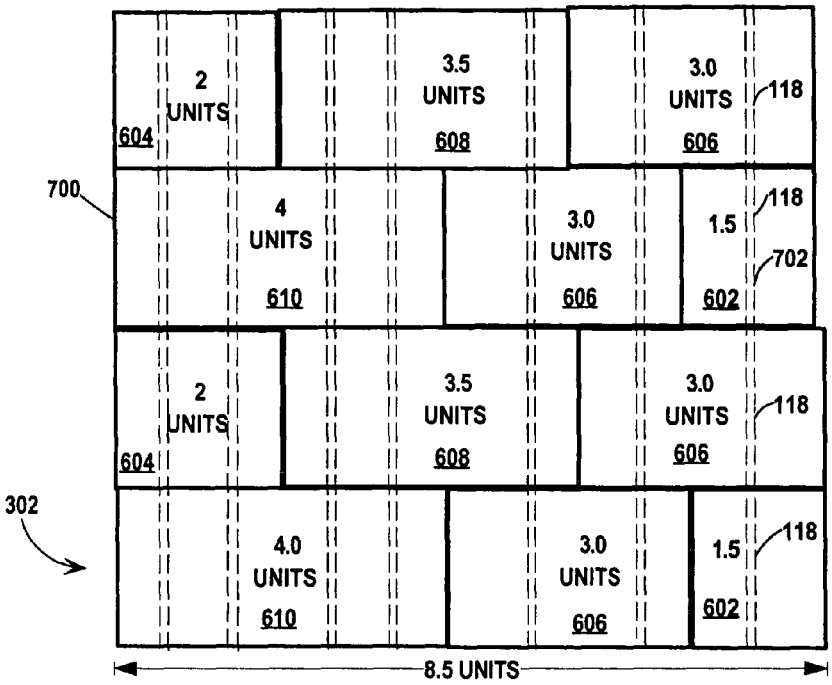
FIG. 7A through FIG. 7D are block diagram side views of exemplary walls constructed using the exemplary wall blocks having different lengths.
Figure 7B:
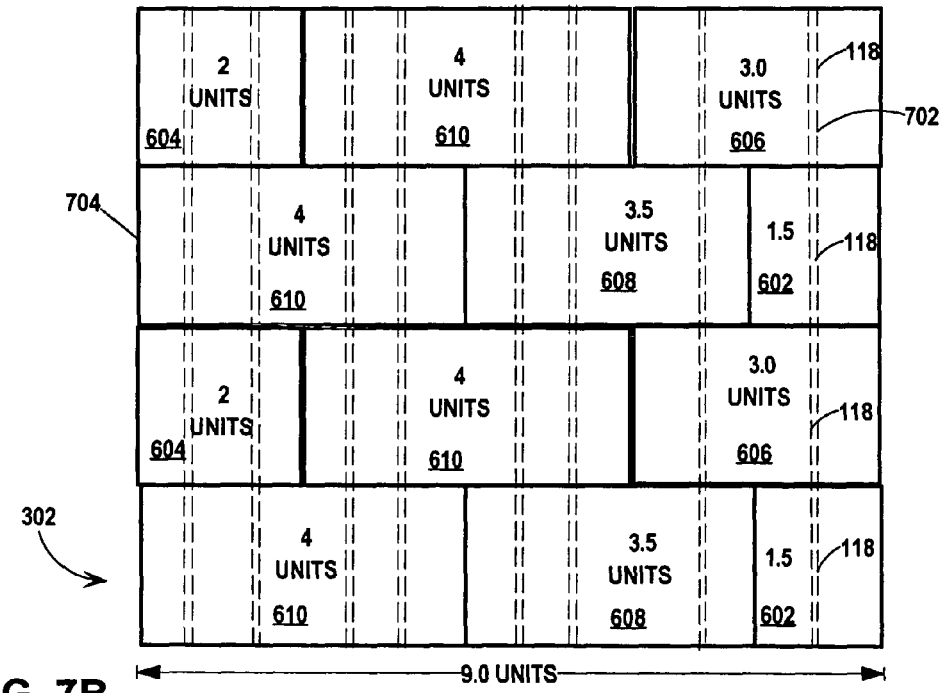
Figure 7C:
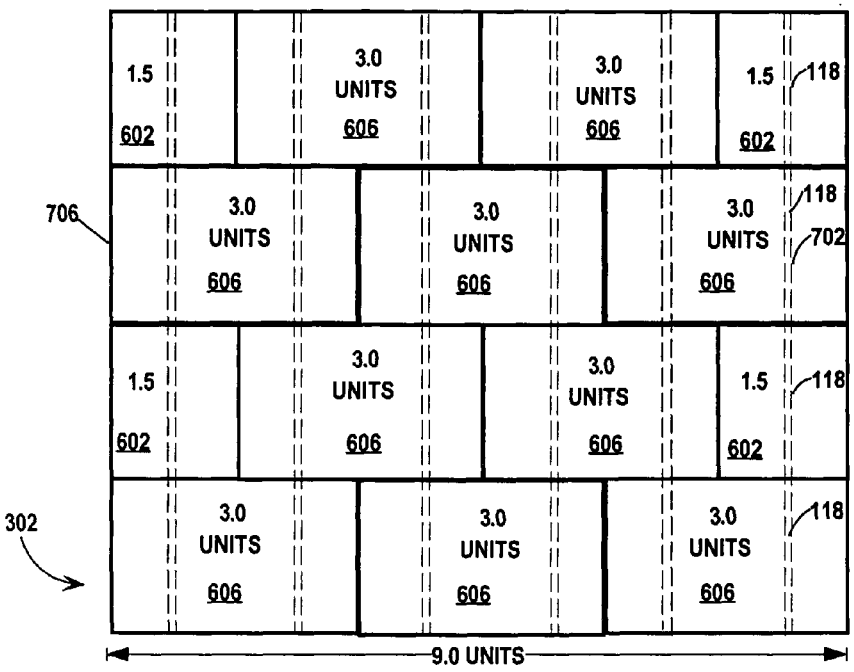
Figure 7D:
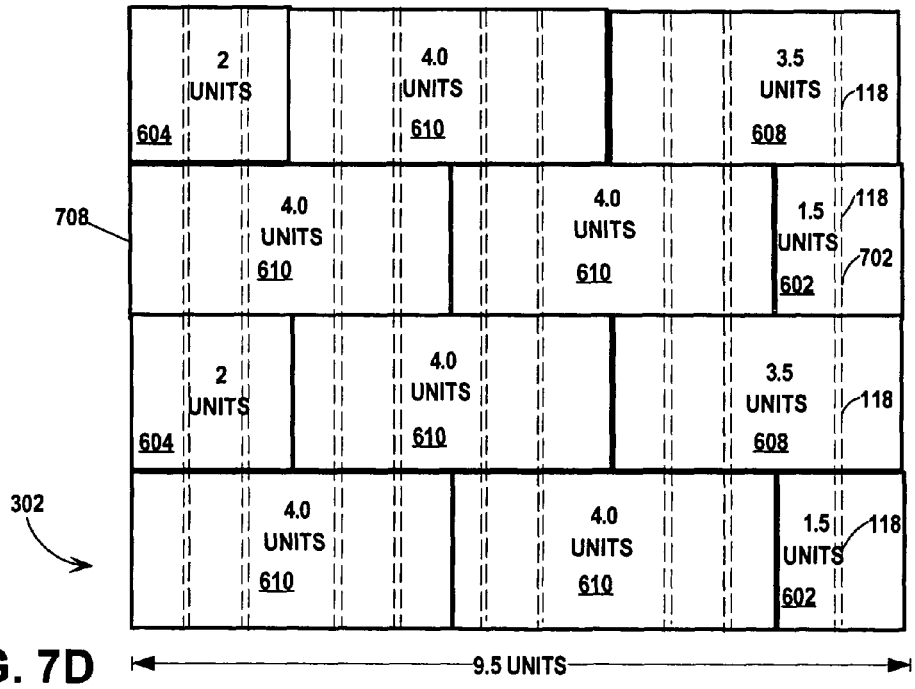

FIG. 7A though FIG. 7D include block diagrams of side views of exemplary walls constructed using the assorted sized wall blocks 600-610. Other walls having different lengths may be constructed using the wall blocks 600-610 and the walls illustrated are provided only as examples of some of the numerous walls that can be constructed using the six different length wall blocks 600-610.

FIG. 7A is a block diagram of a side view of an exemplary wall 700 having a length of 8.5 units constructed using 1.5 unit blocks 602, 2 unit blocks 604, 3 unit blocks 606, 3.5 unit blocks 608 and 4 unit blocks 610. FIG. 7B is a block diagram of a side view of an exemplary wall 704 having a length of 9.0 units constructed using 1.5 unit blocks 602, 2 unit blocks 604, 3 unit blocks 606, 3.5 unit blocks 608 and 4 unit blocks 610. FIG. 7C is a block diagram of a side view of a second exemplary wall 706 having a length of 9 units constructed using 1.5 unit blocks 602, 2 unit blocks 604, 3 unit blocks 606, 3.5 unit blocks 608 and 4 unit blocks 610. FIG. 7D is a block diagram of a side view of an exemplary wall 708 having a length of 9.5 units constructed using 1.5 unit blocks 602, 2 unit blocks 604, 3 unit blocks 606, 3.5 unit blocks 608 and 4 unit blocks 610. Since the wall blocks 600-610 are 2 feet tall in the exemplary embodiments, the exemplary walls 700, 704, 706, 708 are eight feet tall. Wall conduit channels 702 extend through the entire heights of the walls 700, 704, 706, 708 and are formed by the conduit channels 118 in the wall blocks 600-610. The selection of wall blocks 100 for use in the walls 700, 704, 706, 708 depends on the length of the particular wall 700, 704, 706, 708 and the desired placement of the wall conduit channels 702. In general, the blocks 100 are selected to minimize the number of blocks 100 needed for the wall 700, 704, 706, 708 and maximize the number of wall conduit channels 702. The base layer 302 includes base wall blocks which are briefly discussed above as well as in further detail below with reference to FIG. 8 and FIG. 9 and include features to facilitate anchoring the base wall blocks to the foundation of the building.

Figure 8:
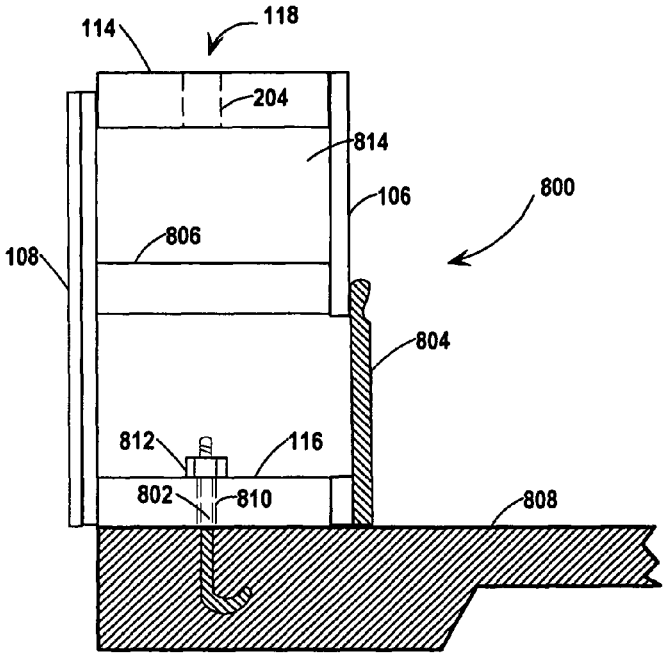
FIG. 8 is an illustration of a side view of a base wall block anchored to a foundation in accordance with the exemplary embodiments of the invention.

FIG. 8 is an illustration of a cross sectional side view of a base wall block 800 in accordance with the exemplary embodiment of the invention. As explained above, each of the differently sized wall blocks 600-610 are manufactured as base wall blocks 800 in addition to being manufactured as standard wall blocks 100. Accordingly, FIG. 8 is a general illustration of a base wall block 800 that can be formed into any number of differently sized wall blocks 100.

The base wall block 800 includes an opening on the one side of the base wall block 800 to allow access to the threaded end of an anchor 802. In the exemplary exterior wall blocks 800, the interior vertical side 102 includes the opening. The interior material wall layer 106 is secured to the edges of the top lateral member 114, an intermediate lateral member 806 and upper vertical side members 814. During construction of the building, a series of anchors 802 are secured to the concrete slab or other type of foundation 808 in accordance with known techniques. The base wall blocks 800 include holes 810 in the bottom lateral member 116 for receiving the ends of the anchors 802. In some circumstances, the holes 810 may be drilled at the construction site. In some situations, however, the base blocks 800 are predrilled and templates are used properly position the anchors 802 in the foundation. After the base wall block 800 is appropriately positioned over the anchors 802, nuts 812 are tightened to firmly secure the base wall blocks 800 to the foundation, floor or slab 808. Baseboards 804 are nailed to the base wall blocks 800 to cover the openings in the blocks 800. In some circumstances, insulation is inserted into base wall block 800 before the baseboards 804 are applied.

Figure 9:
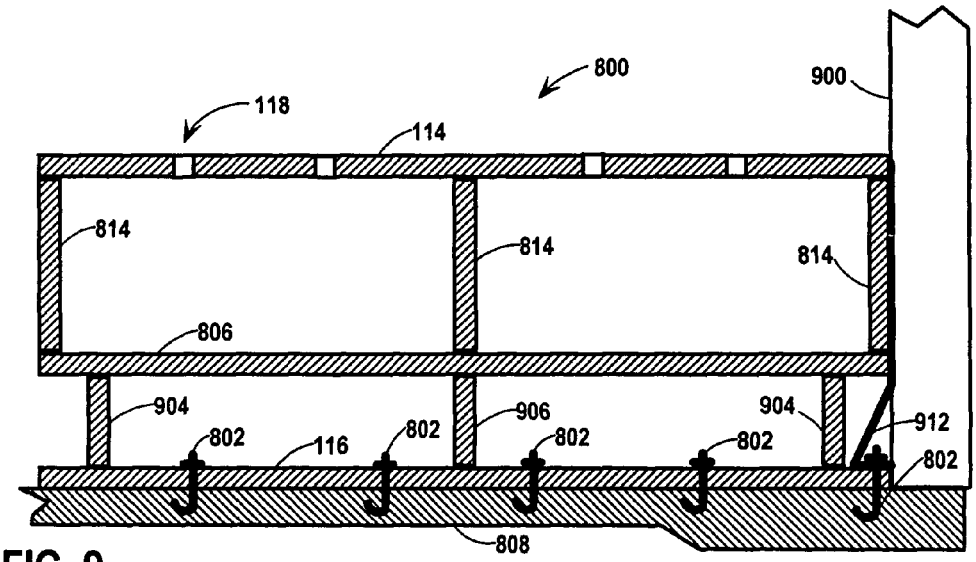
FIG. 9 is an illustration of a cross sectional side view of a base wall block connected to a support post in accordance with the exemplary embodiments of the invention.

FIG. 9 is an illustration of a cross sectional front view of the exemplary base wall block 800 connected to a post 900. A frame 902 of the base wall block 800 includes an interior lateral member 806, upper vertical members 814 and lower vertical members 904-906. The upper vertical members 814 are connected between the top lateral member 114 and the intermediate lateral member 806. The lower vertical members 904, 906 are connected between the intermediate lateral member 806 and the bottom lateral member 116. The side lower vertical members 904 are recessed from the side of the base wall block 800 to provide and open area for mounting a post bracket 912. The post bracket 912 is an angled metal bracket that is secured to the post 900 and the wall block 800. An anchor 802 secured to the foundation 800 extends through the hole 810 in the bottom lateral member 116 and through the post bracket 912.

In the exemplary embodiments, the post 900 includes a solid wood square post that includes a combination of finished exterior and interior layers in accordance with the position and intended use of the particular post 900. For example, where the post 900 is an exterior corner post, the two sides of the post exposed to the exterior of the building are finished to match the exterior material layers 108 of the wall blocks 100. Posts 900 used in forming a wall opening such as window or door to the exterior include an exterior layer on one side and an interior layer on an opposite side. In some wall and building configurations the posts 900 can be omitted.

Door opening such as windows and doors are formed using at least header blocks. In one technique of forming a wall opening, a header block is secured between two posts 900. In other techniques, the posts 900 are eliminated and the header blocks are secured to wall blocks 100. The header blocks may be secured to the posts 900 or wall blocks 100 using any of several techniques meeting engineering requirements. For example, dowels extending from the header blocks into the posts 900 or blocks 100 provide a sufficient method for connecting the header blocks. Further, the header blocks may be secured to the posts 900 or wall blocks 100 using adhesives or other fasteners. The header blocks are wall blocks 100 that include additional features. In most situations, the header block includes an interior exterior layer and an exterior material layer that match the other wall blocks 100 used in the construction. The header blocks may be curved or arched to form an arched wall opening. A groove in the header block accepts flashing material to weatherproof the wall opening. Trimmer posts are secured to the interior of the wall opening by screwing, gluing, nailing or otherwise fastening trimmer posts to the wall blocks 100 or the posts 900. After a window or door is secured to the trimmer posts, the opening is further weatherproofed and molding or trim piece material is applied to cover any weatherproofing materials or other unsightly features.

Figure 10:
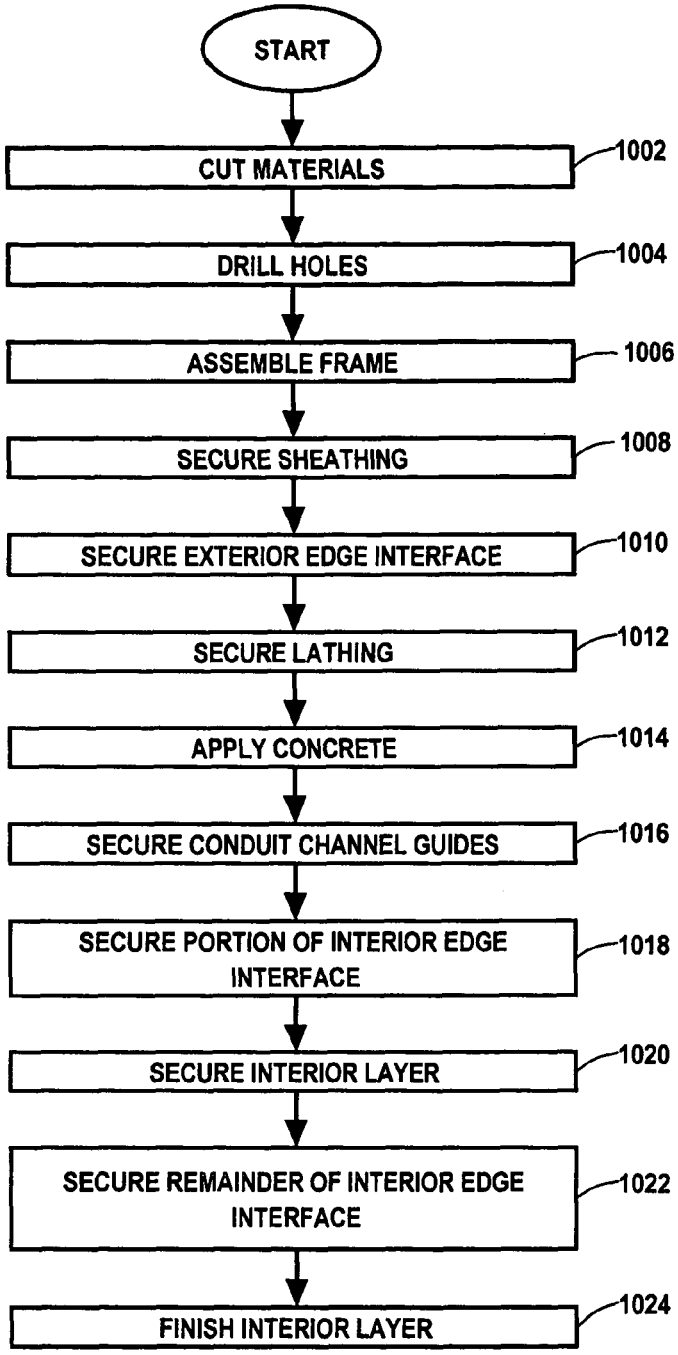
FIG. 10 is a flow chart of an exemplary method of manufacturing a wall block.

FIG. 10 is a flow chart of an exemplary method of manufacturing a wall block 100. The various steps discussed with reference to FIG. 10 may be performed in any order. Further, some steps may be omitted and/or other steps may be added depending on the particular type of wall block 100, materials, and other factors.

At step 1002, materials are cut to form the components of the wall block 100. In the exemplary method, 2×6 lumber is cut to the appropriate size to form the frame members by aligning and cutting several boards simultaneously with a relatively large saw. The sheathing material (OSB or plywood) is cut using large table saws that can cut several sheets simultaneously. Other materials such as the interior wall material layer (drywall) 106 are cut using appropriate equipment and blades in accordance with known techniques.

At step 1004, holes are drilled into the lateral frame members. In the exemplary method, several lateral members for each type of lateral member are aligned in a jig and holes are drilled using a drill press. Where the particular wall block includes at least one conduit channel 118, opening 204 are drilled through the top lateral member 114 and bottom lateral member 116. For base wall blocks 800, openings 204 are drilled only through the top lateral member 114. As explained above, holes 810 for the anchors 810 may be predrilled in the base wall blocks 800. If the holes 810 are predrilled, the bottom lateral members 116 of a base wall block 800 are drilled at locations that correspond to templates that are used to position the anchors 802 in the foundation. Otherwise, the holes 810 are drilled at the construction site after the anchors 802 are secured to the foundation 808.

At step 1006, the frame 110 is assembled. In the exemplary method, the lateral members 114, 116 and the vertical members 112 are held firmly in a jig while the members are attached using screws or nails. The frame members 112, 114, 116 are aligned and secured in the jig such that right angles of the wall block 100 are maintained at 90 degrees while the frame members 112, 114, 116 are connected to form the frame 110.

At step 1008, the sheathing layer 406 is connected to the frame. In the exemplary embodiment, the sheathing layer 406 is aligned and held in place on the frame 110 by a jig. The sheathing layer 406 is attached to the frame 110 using fasteners such as screws or nails.

At step 1010, the exterior edge interface 502 is attached to the wall block 100 along the perimeter of the sheathing layer 406. Fasteners such as screws or nails are used to secure the exterior edge interface 502 to the frame 110 and/or the sheathing layer 406.

At step 1012, the lathing 408 is secured to the sheathing layer 406. In the exemplary embodiment, the lathing 408 includes a moisture barrier such as asphalt felt and a metal lathe. After the asphalt felt is secured to the sheathing material 406 within the exterior edge interface 502, the metal lathe is secured to the sheathing material 406.

At step 1014, the concrete layer 410 is mixed and poured onto the lathing material 408 to secure the concrete layer 410 to the wall block 100. As explained above, other types of exterior layers 108 may be used in some circumstances.

At step 1016, conduit channel guides are secured within the frame 110. In the exemplary embodiment, sections of PVC (Polyvinyl chloride) piping are cut and glued within the openings 204 of the frame 110 after the concrete layer 410 has cured.

At step 1018, a portion of the interior edge interface 420 is secured to the frame 110. In the exemplary embodiment, the interior edge interface 420 is nailed or screwed along three edges of the interior vertical side 102 of the frame 110.

At step 1020, the interior material layer 106 is attached to the frame 110. In the exemplary method, section of drywall is guided into the three sides frame formed by the portion of the interior edge interface 420 and screws or nails are used to firmly secure the interior material layer 106 to the frame 110.

At step 1022, the remainder of the interior edge interface 420 is attached to the frame 110. In the exemplary embodiment, screws or nails are passed through the drywall and the last portion of the interior edge interface 420 into the frame 110 to attach the final section of interior edge interface 420.

At step 1024, the interior material layer 106 is finished. In the exemplary embodiment, the all dents, nails heads, screws tops, indentations, and other imperfections on the surface of the interior material layer 106 are spackled and sanded to form a smooth and uniform surface. A final coat of paint or wall covering such as wall paper is applied to complete the interior material layer 106.

Accordingly, a wall block 100 is formed by securing an interior wall material and an exterior wall material to a frame 100 where the top of the wall block 100 is configured to support one or more other wall blocks 100 to form a wall. The method may be used to construct a wall block 100 having any of several sizes or purposes. For example, the wall blocks 100 of having different lengths may be manufactured to allow the construction of walls having any of several lengths. Further, the exemplary method may be used to build base wall blocks 800 as well as standard wall blocks 100.

Additional steps may be performed in the manufacturing process to facilitate shipping, and wall manufacturing. For example, wall assembly holes may be drilled through portions of the wall blocks 100 at the appropriate angles to provide pilot holes for screws that may be used to secure wall blocks during the wall manufacturing process at the construction site. Further, the wall panels may be wrapped in shrink wrap or other packaging materials to protect the wall panels as well as provide an efficient mechanism for transporting the wall blocks 100.

Figure 11:
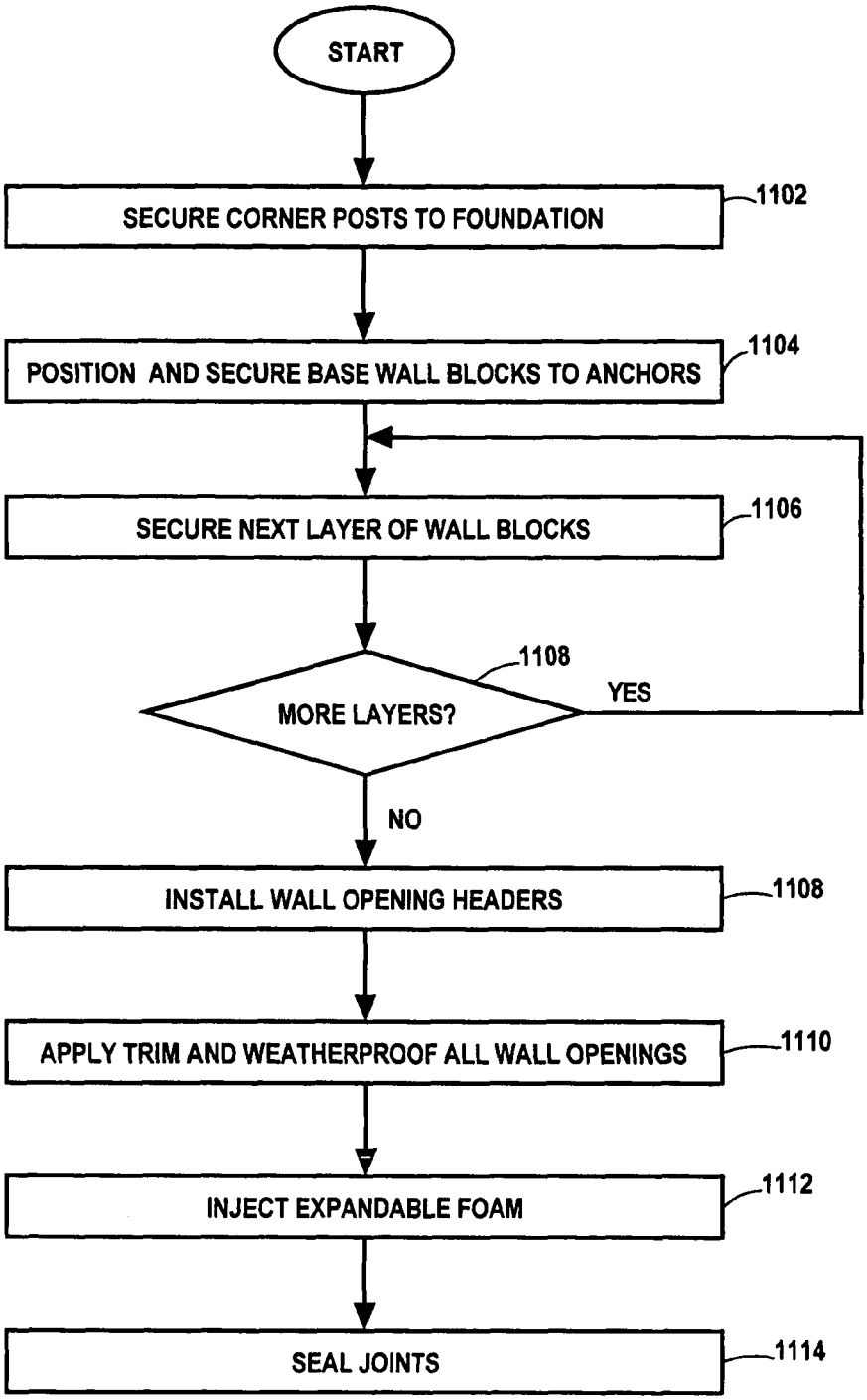
FIG. 11 is a flow chart of an exemplary method of constructing a wall using wall blocks.

FIG. 11 is a flow chart of an exemplary method of forming a wall using wall blocks 100. The steps discussed with reference FIG. 11 may be performed in any order. Further, some steps may be omitted and/or other steps may be added depending on the particular type of wall, building, geographical location of the building site, available materials, building codes and other factors. The method of building a wall generally includes positioning and securing multiple layers 302, 304, 306 of wall blocks 100 by stacking and gluing wall blocks 100. In the exemplary embodiment, several different wall blocks (100) are used to build any of several length walls.

At step 1102, corner posts 900 are secured to the foundation 808. Although in some circumstances the corner posts 900 can be omitted, the corner posts 900 are secured to the foundation 808 temporarily.

At step 1104, base wall blocks 800 are secured to the foundation 808. Anchor holes 810 in the bottom members 116 of the aligned with the anchors 802 mounted in the foundation. Examples of two suitable techniques for aligning the wall blocks with the anchors securing the base wall blocks 800 to the foundation 808 are discussed in further detail below. The base wall blocks 800 are appropriately positioned and glued to form the base layer 302 of the wall. An adhesive is applied between the base wall blocks 800 and between the corner posts 900 and the base wall blocks 800 to bond the vertical end member 112 to other vertical end members 112 of other base wall blocks 800 as well as edges of corner posts 900. An example of suitable adhesive is a construction grade, waterproof adhesive having a shear strength of 2700 PSI such as commercially available Resorcinol products. As the base wall blocks are positioned and glued, the nuts and washers are used to firmly secure the base wall blocks 800 to the foundation 808. The opening at the bottom of a base wall block 800 allows access to the anchors 802.

The base wall blocks 800 can be aligned with the anchors 802 using any of several techniques. In a one exemplary technique, the bottom members 116 of the base wall blocks 800 are predrilled for accepting the anchors and a template is used to position the anchors 802 while the foundation hardens. The templates may be plastic forms that hold the anchors 802 at the appropriate depth and position along the line of the wall after the foundation is poured. In another exemplary technique, the anchors 802 are secured in the foundation 808 and holes 810 are drilled in the wall blocks 800 after careful measurement. Other techniques may utilize a combination of the two techniques where some of holes 810 may be predrilled and some may be drilled at the construction site.

At step 1106, the next layer of wall blocks 100 are positioned and secured. As each block 100 is placed in the wall, adhesive is applied to tops of the lower layer and to the side of the wall block 100 being placed. In the exemplary embodiment, screws are fastened at an angle through the tops of adjacent wall blocks 100 (310, 312) to firmly secure the wall blocks 100 while the adhesive 422 cures.

At step 1108, it is determined if additional wall block layers (306) are needed. If another wall block layer (306) is needed, the method returns to step 1106. Otherwise, the method continues at step 1108, where wall opening headers are installed.

At step 1108, window header and door headers are attached between posts or between the wall blocks 100 within an upper wall block layer. In some circumstances, wooden dowels are applied, in addition to an adhesive, between the headers and wall blocks 100 or posts.

At step 1110, the wall openings are weatherproofed. Trim sections and sealants are applied around along the perimeter of the windows and doors. Baseboards are applied to the bottom of base wall blocks 800 to cover open area used to gain access to the anchors 902.

At step 1112, expandable foam 428 is injected into the joints between the wall blocks 100. As discussed above, examples of suitable expandable foams 428 include expanding single-component polyurethane foam sealants.

At step 1114, the joints are sealed. The exterior joints are fished by applying a grout, caulk, or sealant. In the exemplary method, a caulk 426 is applied to the interior joints.

Therefore, in the exemplary embodiments, several types of wall blocks 100 are manufactured in several lengths (600-610) where the tops of the wall blocks 100 are configured to support other wall blocks 100 allowing the wall blocks 100 to be stacked to form a wall 300. An adhesive is applied between the vertical and horizontal interfaces between the wall blocks 100 to secure the wall blocks 100 within the wall 300. The exemplary embodiments and methods described above provide a system, apparatus, and method for quickly and efficiently constructing a wall at lower cost than conventional systems. Since no sanding or other finishing is required, debris and dust is minimizing the time and effort required to clean and prepare the building for habitation. Further, precise manufacturing techniques at a manufacturing facility minimizing errors and defects in the walls.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

What is claimed is:

1. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side; and comprising a section of planar interior wall material; and a second finished wall material layer comprising wire-reinforced concrete and secured to the second vertical side and non-contiguous with the first finished wall material layer, the wall block having a top configured to support at least one other wall block.

2. A building wall in accordance with claim 1, further comprising:

adhesive between the plurality of wall blocks forming a bond between adjacent wall blocks and between lower wall blocks supporting upper wall blocks.

3. A building wall in accordance with claim 1, wherein the section of planar interior wall material is selected from the group comprising drywall, gypsum board, wood paneling, and synthetic paneling and wherein the second finished wall material layer is stamped concrete or stucco.

4. A building wall in accordance with claim 1, wherein the planar interior wall material layer is a planar sheet of drywall.

5. A building wall in accordance with claim 1, wherein the planar interior wall material layer is a planar sheet of gypsum board.

6. A building wall in accordance with claim 1, wherein the planar interior wall material layer is a planar sheet of plywood.

7. A building wall in accordance with claim 1, wherein the planar interior wall layer is a planar sheet of paneling.

8. A building wall in accordance with claim 1, wherein the second finished wall material layer is an exterior wall material layer.

9. A building wall in accordance with claim 1, wherein the concrete is configured to resemble stone.

10. A building wall in accordance with claim 1, wherein the concrete is configured to resemble brick.

11. A building wall in accordance with claim 8, wherein the exterior wall material layer includes a stucco surface.

12. A building wall in accordance with claim 1, wherein each wall block further comprises:

a bottom opposite the top, the bottom configured to interface with the tops of one or more other wall blocks when the wall block is placed on top of the one or more other wall blocks.

13. A building wall in accordance with claim 12, the building wall comprising a plurality of wall conduit channels extending from a top of the building wall through at least one wall block layer, at least some of the wall blocks further comprising at least one conduit channel extending vertically from the top to the bottom of the wall block.

14. A building wall in accordance with claim 13, wherein the at least one conduit channel comprises a cylindrical conduit channel guide positioned between holes in the top and bottom.

15. A building wall in accordance with claim 12, wherein each wall block has a shape in accordance with a rectangular prism and further comprises:

a first end connected to edges of the top, the bottom, the first finished wall material layer and the second finished wall material layer; and a second end connected, opposite the first end, to opposite edges of the top, the bottom, the first finished wall material layer and the second finished wall layer.

16. A building wall in accordance with claim 15, wherein the first end, the second end, the top, the bottom, first finished wall material layer and the second finished wall material layer are rectangular.

17. A building wall in accordance claim 12, wherein the plurality of wall blocks comprises:

a 4 unit wall block having a length of 4 units and comprising four conduit channels, the 4 unit wall block positioned in a first wall block layer; and a 3.5 unit wall block having a length of 3.5 units and comprising 3 conduit channels, the 3.5 unit wall block layer positioned in second wall block layer to align two of the conduit channels in the 4 unit wall block with two conduit channels in the 3.5 unit wall block to form two wall conduit channels.

18. A building wall in accordance claim 17, wherein the plurality of wall blocks further comprises:

a 2 unit wall block having a length of 2 units and comprising two conduit channels positioned in a first wall block layer to align two other conduit channels of the 4 unit wall block with the conduit channels in the 2 unit wall block; and a 1.5 unit wall block having a length of 1.5 units and comprising one conduit channel, the 1.5 unit wall block layer positioned in second wall block layer to align the conduit channel of the 1.5 unit wall block with the other conduit channel of the 3.5 unit wall block.

19. A building wall in accordance with claim 18, wherein a length of the building wall is multiple of 9.5 units.

20. A building wall in accordance with claim 18, wherein the plurality of wall blocks further comprises:

a plurality of 3 unit wall blocks having a length of 3 units and comprising two conduit channels, the 3 unit wall blocks positioned in a plurality of wall block layers to align at least one conduit channel of a 3 unit wall block in one layer with at least one conduit channel of another 3 unit wall block in another layer.

21. A building wall in accordance with claim 20, wherein the other conduit channel of some of the 3 unit wall blocks is aligned with the other conduit channel of the 3.5 unit wall block.

22. A building wall in accordance with claim 21, wherein the other conduit channel of some of the 3 unit wall blocks is aligned with the conduit channel of the 1.5 unit wall block.

23. A building wall in accordance with claim 21 wherein a length of the building wall is multiple of 8.5 units.

24. A building wall in accordance claim 12, wherein the plurality of wall blocks comprises:

a plurality of 3 unit wall blocks having a length of 3 units and comprising two conduit channels, the 3 unit wall blocks positioned in a plurality of wall block layers to align at least one conduit channel of a 3 unit wall block in one layer with at least one conduit channel of another 3 unit wall block in another wall block layer to form at least one wall conduit channel.

25. A building wall in accordance claim 24, wherein the plurality of wall blocks further comprises:

a 1.5 unit wall block having a length of 1.5 units and comprising 1 conduit channel, the 1.5 unit wall block layer positioned in wall block layer to align the conduit channel of the 1.5 unit wall block with the other conduit channel of one of the 3 unit wall blocks.

26. A building wall in accordance with claim 25, wherein a length of the building wall is multiple of 9.0 units.

27. A building wall in accordance with claim 1, wherein the plurality of wall blocks comprise:

a plurality of base wall blocks having open area providing access to an interior of the base wall block.

28. A building wall in accordance with claim 27, each base wall block comprising a bottom lateral member having holes for receiving shafts of anchors secured in a foundation.

29. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side and comprising a section of planar interior wall material; and a second finished wall material layer comprising wire-reinforced concrete, the second finished wall material layer secured to the second vertical side and non-contiguous with the first finished wall material layer, at least one of the first finished wall material layer and the second finished wall material layer secured to the frame before the wall block is secured within the building wall.

30. A building wall in accordance with claim 29, further comprising:

adhesive between the plurality of wall blocks forming a bond between adjacent wall blocks and between lower wall blocks supporting upper wall blocks.

31. A building wall in accordance with claim 29, wherein the section of planar interior wall material is selected from the group comprising drywall, gypsum board, wood paneling, and synthetic paneling and wherein the second finished wall material layer is stamped concrete or stucco.

32. A building wall in accordance with claim 29, wherein the planar interior wall material is a planar sheet of drywall.

33. A building wall in accordance with claim 29, wherein the planar interior wall material is a planar sheet of gypsum board.

34. A building wall in accordance with claim 29, wherein the planar interior wall material is a planar sheet of plywood.

35. A building wall in accordance with claim 29, wherein the planar interior wall material is a planar sheet of paneling.

36. A building wall in accordance with claim 29, wherein the second finished wall material layer is an exterior wall material layer.

37. A building wall in accordance with claim 29, wherein the concrete is configured to resemble stone.

38. A building wall in accordance with claim 29, wherein the concrete is configured to resemble brick.

39. A building wall in accordance with claim 29, wherein the exterior wall material layer includes a stucco surface.

40. A building wall in accordance with claim 29, wherein the wall block has a top configured to support one or more upper wall blocks and a bottom opposite the top, the bottom configured to interface with the tops of one or more lower wall blocks when the wall block is placed on top of the one or more lower wall blocks to form the building wall.

41. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side and comprising a section of planar interior wall material; and a second finished wall material layer including a stucco surface and secured to the second vertical side and non-contiguous with the first finished wall material layer, the wall block having a top configured to support at least one other wall block.

42. A building wall in accordance with claim 41, further comprising:

adhesive between the plurality of wall blocks forming a bond between adjacent wall blocks and between lower wall blocks supporting upper wall blocks.

43. A building wall in accordance with claim 41, wherein the section of planar interior wall material is selected from the group comprising drywall, gypsum board, wood paneling, and synthetic paneling.

44. A building wall in accordance with claim 41, wherein the planar interior wall material layer is a planar sheet of drywall.

45. A building wall in accordance with claim 41, wherein the planar interior wall material layer is a planar sheet of gypsum board.

46. A building wall in accordance with claim 41, wherein the planar interior wall material is a planar sheet of plywood.

47. A building wall in accordance with claim 41, wherein the planar interior wall material is a planar sheet of paneling.

48. A building wall in accordance with claim 41, wherein the second finished wall material layer is an exterior wall material layer.

49. A building wall in accordance with claim 41, wherein each wall block further comprises:

a bottom opposite the top, the bottom configured to interface with the tops of one or more other wall blocks when the wall block is placed on top of the one or more other wall blocks.

50. A building wall in accordance with claim 49, the building wall comprising a plurality of wall conduit channels extending from a top of the building wall through at least one wall block layer, at least some of the wall blocks further comprising at least one conduit channel extending vertically from the top to the bottom of the wall block.

51. A building wall in accordance with claim 50, wherein the at least one conduit channel comprises a cylindrical conduit channel guide positioned between holes in the top and bottom.

52. A building wall in accordance with claim 49, wherein each wall block has a shape in accordance with a rectangular prism and further comprises:

a first end connected to edges of the top, the bottom, the first finished wall material layer and the second finished wall material layer; and a second end connected, opposite the first end, to opposite edges of the top, the bottom, the first finished wall material layer and the second finished wall material layer.

53. A building wall in accordance with claim 52, wherein the first end, the second end, the top, the bottom, first finished wall material layer and the second finished wall material layer are rectangular.

54. A building wall in accordance with claim 49, wherein the plurality of wall blocks comprises:

a 4 unit wall block having a length of 4 units and comprising four conduit channels, the 4 unit wall block positioned in a first wall block layer; and a 3.5 unit wall block having a length of 3.5 units and comprising 3 conduit channels, the 3.5 unit wall block positioned in a second wall block layer to align two of the conduit channels in the 4 unit wall block with two conduit channels in the 3.5 unit wall block to form two wall conduit channels.

55. A building wall in accordance with claim 54, wherein the plurality of wall blocks further comprises:

a 2 unit wall block having a length of 2 units and comprising two conduit channels positioned in the first wall block layer to align two other conduit channels of the 4 unit wall block with the conduit channels in the 2 unit wall block; and a 1.5 unit wall block having a length of 1.5 units and comprising one conduit channel, the 1.5 unit wall block positioned in the second wall block layer to align the conduit channel of the 1.5 unit wall block with the other conduit channel of the 3.5 unit wall block.

56. A building wall in accordance with claim 55, wherein a length of the building wall is multiple of 9.5 units.

57. A building wall in accordance with claim 55, wherein the plurality of wall blocks further comprises:

a plurality of 3 unit wall blocks having a length of 3 units and comprising two conduit channels, the 3 unit wall blocks positioned in a plurality of wall block layers to align at least one conduit channel of a 3 unit wall block in one layer with at least one conduit channel of another 3 unit wall block in another layer.

58. A building wall in accordance with claim 57, wherein the other conduit channel of some of the 3 unit wall blocks is aligned with the other conduit channel of the 3.5 unit wall block.

59. A building wall in accordance with claim 58, wherein the other conduit channel of some of the 3 unit wall blocks is aligned with the conduit channel of the 1.5 unit wall block.

60. A building wall in accordance with claim 58 wherein a length of the building wall is multiple of 8.5 units.

61. A building wall in accordance with claim 49, wherein the plurality of wall blocks comprises:

a plurality of 3 unit wall blocks having a length of 3 units and comprising two conduit channels, the 3 unit wall blocks positioned in a plurality of wall block layers to align at least one conduit channel of a 3 unit wall block in one wall block layer with at least one conduit channel of another 3 unit wall block in another wall block layer to form at least one wall conduit channel.

62. A building wall in accordance claim 61, wherein the plurality of wall blocks further comprises:

a 1.5 unit wall block having a length of 1.5 units and comprising 1 conduit channel, the 1.5 unit wall block positioned in another wall block layer to align the conduit channel of the 1.5 unit wall block with the other conduit channel of one of the 3 unit wall blocks.

63. A building wall in accordance with claim 62, wherein a length of the building wall is multiple of 9.0 units.

64. A building wall in accordance with claim 41, wherein the plurality of wall blocks comprise:

a plurality of base wall blocks having open area providing access to an interior of the base wall block.

65. A building wall in accordance with claim 64, each base wall block comprising a bottom lateral member having holes for receiving shafts of anchors secured in a foundation.

66. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side and comprising a section of planar interior wall material; and a second finished wall material layer including a stucco surface, the second finished wall material layer secured to the second vertical side and non-contiguous with the first finished wall material layer, at least one of the first finished wall material layer and the second finished wall material layer secured to the frame before the wall block is secured within the building wall.

67. A building wall in accordance with claim 66, further comprising:

adhesive between the plurality of wall blocks forming a bond between adjacent wall blocks and between lower wall blocks supporting upper wall blocks.

68. A building wall in accordance with claim 66, wherein the section of planar interior wall material is selected from the group comprising drywall, gypsum board, wood paneling, and synthetic paneling.

69. A building wall in accordance with claim 66, wherein the planar interior wall material is a planar sheet of drywall.

70. A building wall in accordance with claim 66, wherein the planar interior wall material is a planar sheet of gypsum board.

71. A building wall in accordance with claim 66, wherein the planar interior wall material is a planar sheet of plywood.

72. A building wall in accordance with claim 66, wherein the planar interior wall material is a planar sheet of paneling.

73. A building wall in accordance with claim 66, wherein the second finished wall material layer is an exterior wall material layer.

74. A building wall in accordance with claim 73, wherein the exterior wall material layer comprises wire-reinforced concrete.

75. A building wall in accordance with claim 66, wherein the wall block has a top configured to support one or more upper wall blocks and a bottom opposite the top, the bottom configured to interface with the tops of one or more lower wall blocks when the wall block is placed on top of the one or more lower wall blocks to form the building wall.

76. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side and comprising a section of planar interior wall material; and a second finished wall material layer comprising a prefabricated synthetic simulated panel, the second finished wall material layer secured to the second vertical side and non-contiguous with the first finished wall material layer, the wall block having a top configured to support at least one other wall block.

77. A building wall in accordance with claim 76, further comprising:

adhesive between the plurality of wall blocks forming a bond between adjacent wall blocks and between lower wall blocks supporting upper wall blocks.

78. A building wall in accordance with claim 76, wherein the section of planar interior wall material is selected from the group comprising drywall, gypsum board, wood paneling, and synthetic paneling and wherein the second finished wall material layer having a simulated surface.

79. A building wall in accordance with claim 76, wherein the planar interior wall material layer is a planar sheet of drywall.

80. A building wall in accordance with claim 76, wherein the planar interior wall material layer is a planar sheet of gypsum board.

81. A building wall in accordance with claim 76, wherein the planar interior wall material is a planar sheet of plywood.

82. A building wall in accordance with claim 76, wherein the planar interior wall material is a planar sheet of paneling.

83. A building wall in accordance with claim 76, wherein the second finished wall material layer is an exterior wall material layer.

84. A building wall in accordance with claim 83, wherein the prefabricated synthetic simulated panel comprises a polypropylene simulated stone panel.

85. A building wall in accordance with claim 76, wherein each wall block further comprises:

a bottom opposite the top, the bottom configured to interface with the tops of one or more other wall blocks when the wall block is placed on top of the one or more other wall blocks.

86. A building wall in accordance with claim 85, the building wall comprising a plurality of wall conduit channels extending from a top of the building wall through at least one wall block layer, at least some of the wall blocks further comprising at least one conduit channel extending vertically from the top to the bottom of the wall block.

87. A building wall in accordance with claim 86, wherein the at least one conduit channel comprises a cylindrical conduit channel guide positioned between holes in the top and bottom.

88. A building wall in accordance with claim 85, wherein each wall block has a shape in accordance with a rectangular prism and further comprises:

a first end connected to edges of the top, the bottom, the first finished wall material layer and the second finished wall material layer; and a second end connected, opposite the first end, to opposite edges of the top, the bottom, the first finished wall material layer and the second finished wall material layer.

89. A building wall in accordance with claim 88, wherein the first end, the second end, the top, the bottom, first finished wall material layer and the second finished wall material layer are rectangular.

90. A building wall in accordance with claim 85, wherein the plurality of wall blocks comprises:

a 4 unit wall block having a length of 4 units and comprising four conduit channels, the 4 unit wall block positioned in a first wall block layer; and a 3.5 unit wall block having a length of 3.5 units and comprising 3 conduit channels, the 3.5 unit wall block positioned in a second wall block layer to align two of the conduit channels in the 4 unit wall block with two conduit channels in the 3.5 unit wall block to form two wall conduit channels.

91. A building wall in accordance with claim 90, wherein the plurality of wall blocks further comprises:

a 2 unit wall block having a length of 2 units and comprising two conduit channels positioned in the first wall block layer to align two other conduit channels of the 4 unit wall block with the conduit channels in the 2 unit wall block; and a 1.5 unit wall block having a length of 1.5 units and comprising one conduit channel, the 1.5 unit wall block positioned in the second wall block layer to align the conduit channel of the 1.5 unit wall block with the other conduit channel of the 3.5 unit wall block.

92. A building wall in accordance with claim 91, wherein a length of the building wall is multiple of 9.5 units.

93. A building wall in accordance with claim 91, wherein the plurality of wall blocks further comprises:

a plurality of 3 unit wall blocks having a length of 3 units and comprising two conduit channels, the 3 unit wall blocks positioned in a plurality of wall block layers to align at least one conduit channel of a 3 unit wall block in one layer with at least one conduit channel of another 3 unit wall block in another layer.

94. A building wall in accordance with claim 93, wherein the other conduit channel of some of the 3 unit wall blocks is aligned with the other conduit channel of the 3.5 unit wall block.

95. A building wall in accordance with claim 94, wherein the other conduit channel of some of the 3 unit wall blocks is aligned with the conduit channel of the 1.5 unit wall block.

96. A building wall in accordance with claim 94 wherein a length of the building wall is multiple of 8.5 units.

97. A building wall in accordance with claim 85, wherein the plurality of wall blocks comprises:

a plurality of 3 unit wall blocks having a length of 3 units and comprising two conduit channels, the 3 unit wall blocks positioned in a plurality of wall block layers to align at least one conduit channel of a 3 unit wall block in one wall block layer with at least one conduit channel of another 3 unit wall block in another wall block layer to form at least one wall conduit channel.

98. A building wall in accordance claim 97, wherein the plurality of wall blocks further comprises:

a 1.5 unit wall block having a length of 1.5 units and comprising 1 conduit channel, the 1.5 unit wall block positioned in another wall block layer to align the conduit channel of the 1.5 unit wall block with the other conduit channel of one of the 3 unit wall blocks.

99. A building wall in accordance with claim 98, wherein a length of the building wall is multiple of 9.0 units.

100. A building wall in accordance with claim 76, wherein the plurality of wall blocks comprise:

a plurality of base wall blocks having open area providing access to an interior of the base wall block.

101. A building wall in accordance with claim 100, each base wall block comprising a bottom lateral member having holes for receiving shafts of anchors secured in a foundation.

102. A building wall comprising:

a plurality of wall blocks arranged in vertically stacked horizontal layers, each wall block comprising:

a frame having a first vertical side and a second vertical side opposite the first vertical side;

a first finished wall material layer secured to the first vertical side and comprising a section of planar interior wall material; and a second finished wall material layer comprising a prefabricated synthetic simulated panel, the second finished wall material layer secured to the second vertical side and non-contiguous with the first finished wall material layer, at least one of the first finished wall material layer and the second finished wall material layer secured to the frame before the wall block is secured within the building wall.

103. A building wall in accordance with claim 102, further comprising:

adhesive between the plurality of wall blocks forming a bond between adjacent wall blocks and between lower wall blocks supporting upper wall blocks.

104. A building wall in accordance with claim 102, wherein the section of planar interior wall material is selected from the group comprising drywall, gypsum board, wood paneling, and synthetic paneling and wherein the second finished wall material layer having a simulated surface.

105. A building wall in accordance with claim 102, wherein the planar interior wall material is a planar sheet of drywall.

106. A building wall in accordance with claim 102, wherein the planar interior wall material is a planar sheet of gypsum board.

107. A building wall in accordance with claim 102, wherein the planar interior wall material is a planar sheet of plywood.

108. A building wall in accordance with claim 102, wherein the planar interior wall material is a planar sheet of paneling.

109. A building wall in accordance with claim 102, wherein the second finished wall material layer is an exterior wall material layer.

110. A building wall in accordance with claim 102, wherein the prefabricated synthetic simulated panel comprises a polypropylene simulated stone panel.

111. A building wall in accordance with claim 102, wherein the wall block has a top configured to support one or more upper wall blocks and a bottom opposite the top, the bottom configured to interface with the tops of one or more lower wall blocks when the wall block is placed on top of the one or more lower wall blocks to form the building wall.

* * * * *